US008658954B2

(12) United States Patent
Song et al.

(10) Patent No.: US 8,658,954 B2
(45) Date of Patent: Feb. 25, 2014

(54) MICROWAVE OVEN INCLUDING HOOD

(75) Inventors: Sung Bae Song, Seoul (KR); Young Gyu Jung, Seoul (KR); Won Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 582 days.

(21) Appl. No.: 12/704,247

(22) Filed: Feb. 11, 2010

(65) Prior Publication Data

US 2010/0200578 A1 Aug. 12, 2010

(30) Foreign Application Priority Data

Feb. 11, 2009 (KR) ..... 10-2009-0010991

(51) Int. Cl.
*H05B 6/64* (2006.01)
*F24F 7/00* (2006.01)

(52) U.S. Cl.
USPC ..... 219/757; 219/680; 219/756; 219/758; 454/63

(58) Field of Classification Search
None
See application file for complete search history.

(56) References Cited

U.S. PATENT DOCUMENTS

| | | | | |
|---|---|---|---|---|
| RE37,706 | E * | 5/2002 | Chung | 99/404 |
| 6,717,123 | B1 * | 4/2004 | Kim | 219/757 |
| 2003/0082069 | A1 * | 5/2003 | Kuzyk | 422/1 |

FOREIGN PATENT DOCUMENTS

| | | | |
|---|---|---|---|
| CN | 1464228 | A | 12/2003 |
| CN | 1465907 | A | 1/2004 |
| CN | 1482396 | A | 3/2004 |
| CN | 1506619 | A | 6/2004 |

* cited by examiner

*Primary Examiner* — Johannes P Mondt
(74) *Attorney, Agent, or Firm* — McKenna Long & Aldridge, LLP

(57) ABSTRACT

A microwave oven including an extendable/retractable hood assembly is provided. The microwave oven draws contaminated air through intake ports that are provided in a hood casing and a hood. The hood is slidably received in the hood casing. Thus, the hood is retracted or extended from the hood casing to more efficiently perform an air exhaust function.

12 Claims, 12 Drawing Sheets

MICROWAVE OVEN INCLUDING HOOD

The present application claims priority under 35 U.S.C. §119 and 35 U.S.C. §365 to Korean Patent Application No. 10-2009-0010991, filed Feb. 11, 2009, which is hereby incorporated by reference for all purposes as if fully set forth herein in its entirety.

BACKGROUND OF THE INVENTION

1. Field of the Invention

The present disclosure relates to a microwave oven including a hood, and more particularly, to a microwave oven including an extendable/retractable hood and the extendable/retractable hood itself.

2. Discussion of the Related Art

A microwave oven is a cooking appliance that employs microwave radiation to heat food. Such a microwave oven may include a hood that evacuates contaminated air generated while cooking food in an indoor space, such as a kitchen. More particularly, a hood of a microwave oven draws in contaminated air that is generated while cooking food at a cooking device disposed below the microwave oven. Furthermore, a hood of a microwave oven exhausts the contaminated air to an outdoor space, or purifies the air and then circulates the air back to an indoor space.

SUMMARY OF THE INVENTION

A microwave oven including an extendable/retractable hood and the extendable/retractable hood assembly itself, which is configured to efficiently perform an air exhaust function is disclosed.

In one embodiment, a microwave oven configured to be positioned above a cooking device, may comprises: a cooking chamber, a high frequency heat source, a hood casing disposed below the cooking chamber, the hood casing including a first intake port into which air is drawn, a hood slidably received in the hood casing, the hood including a second intake port into which air is drawn, a fan adapted to draw air in through at least one of the first and second intake ports, a driving motor to generate a drive force to slidably extend the hood from or retract the hood into the hood casing, and a transmission member to transmit the drive force from driving motor to the hood.

As described and illustrated in the exemplary embodiments herein, an extendable/retractable hood assembly to exhaust, or filter and exhaust, air from above a cooking device disposed below the extendable/retractable hood assembly, may comprise: a stationary member having a first air intake port, the stationary member defining an first air collection area, a movable member slidably received within the stationary member, wherein the movable member defines a variable size air collection area that includes the first air collection area and is greater than the first air collection area in proportion to the position of the movable member as it is extended from the stationary member, a fan adapted to draw air into the extendable/retractable hood assembly through at least the first air intake port; and a driving unit adapted to generate and transmit a driving force to the movable member to extend the movable member from or retract the movable member into the stationary member.

The foregoing and other features, aspects, and advantages of the present invention will become more apparent from the following detailed description of the present invention when taken in conjunction with the accompanying drawings.

DETAILED DESCRIPTION OF THE ILLUSTRATED EMBODIMENTS

Reference will now be made in detail to embodiments of the invention, examples of which are illustrated in the accompanying drawings.

Figure 1:
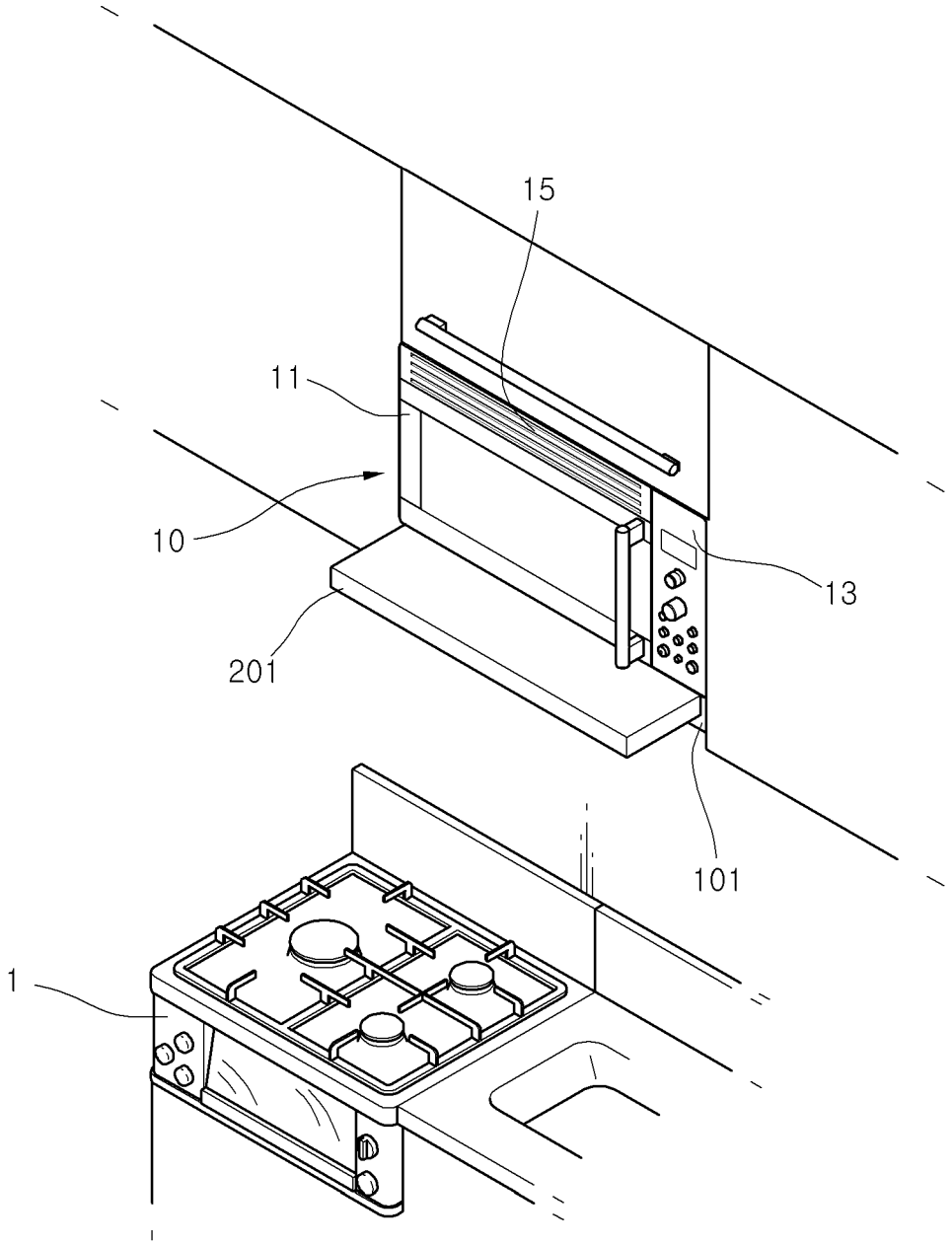
FIG. 1 is a perspective view illustrating a microwave oven including an extendable/retractable hood (hereinafter "hood"), according to an embodiment of the invention.
Figure 2:
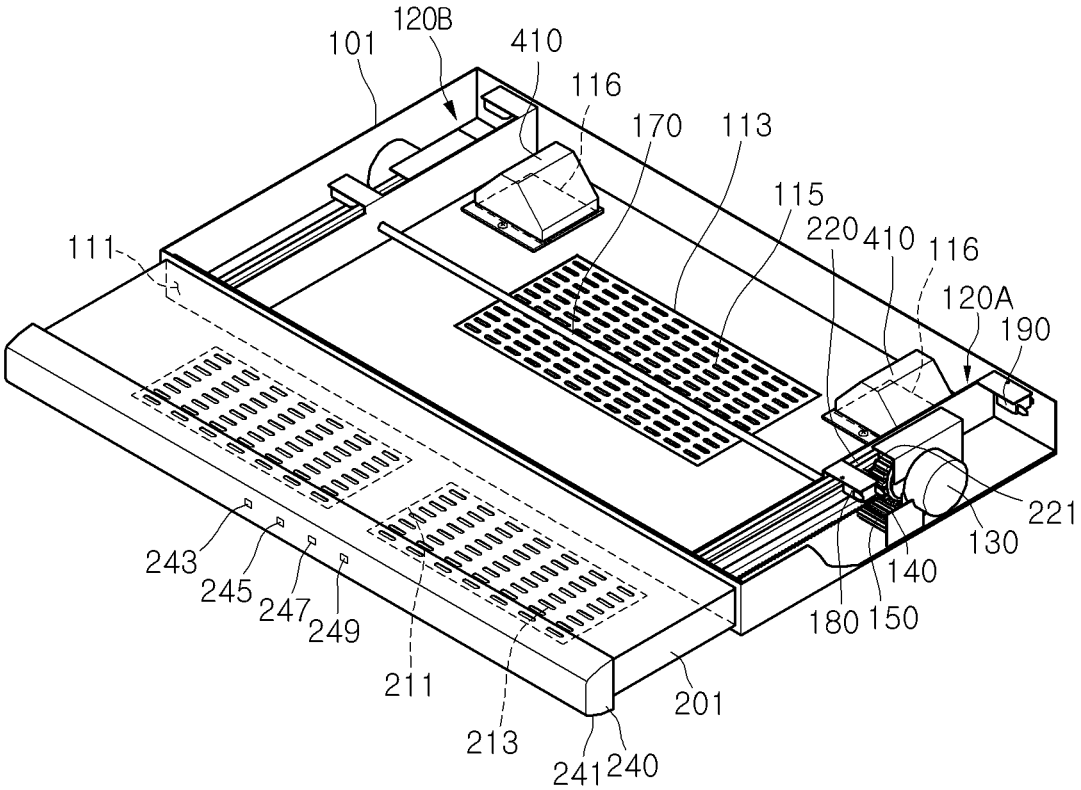
FIG. 2 is a perspective view illustrating the hood of the microwave oven of FIG. 1.
Figure 3:
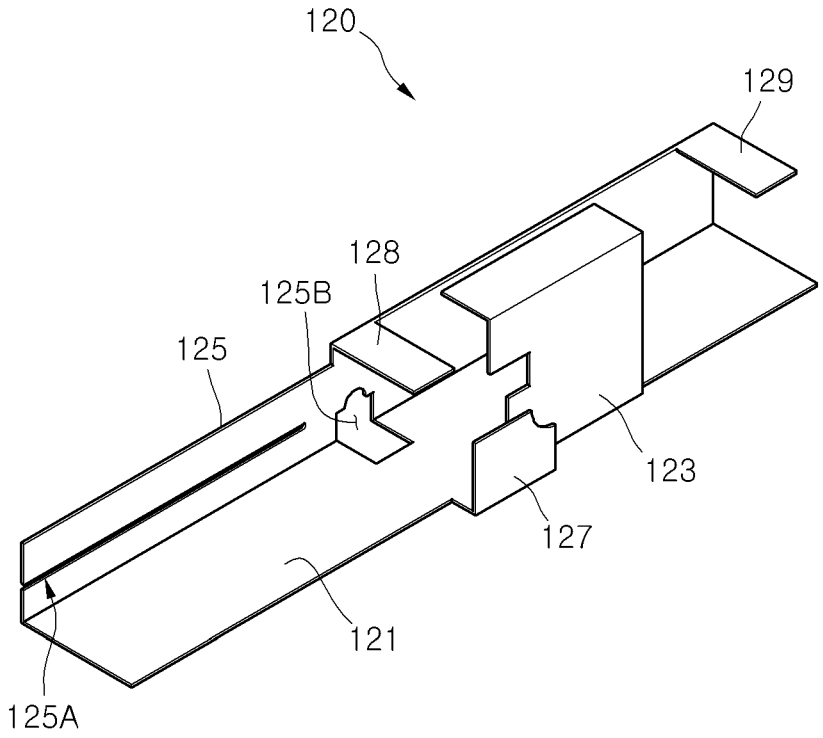
FIG. 3 is a perspective view illustrating an installation bracket of the hood of the microwave oven of FIG. 1.
Figure 4:
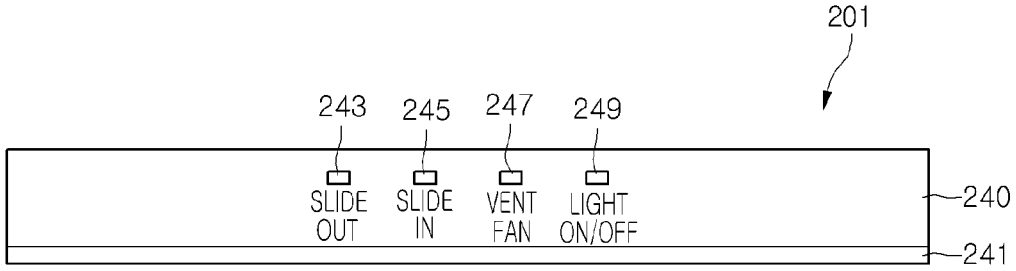
FIG. 4 is a front view illustrating a front panel of the hood of the microwave oven of FIG. 1.
Figure 5:
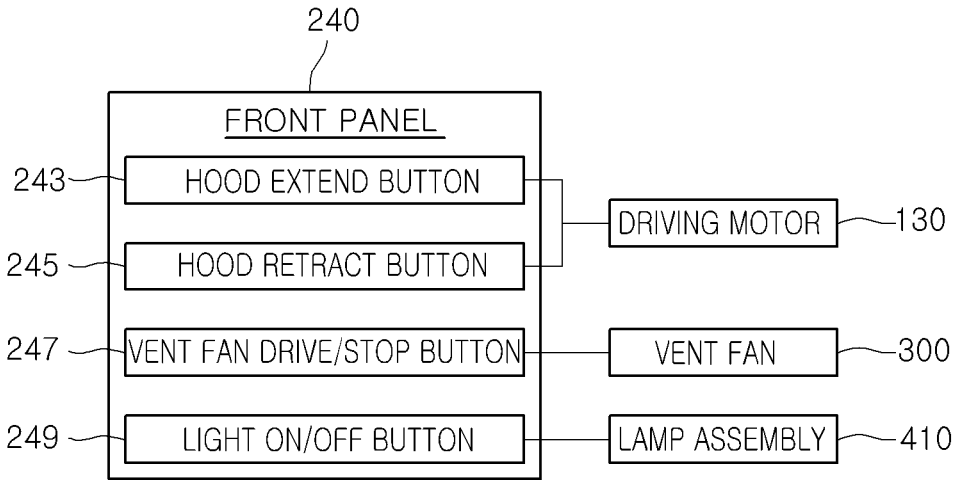
FIG. 5 is a block diagram of the hood of the microwave oven of FIG. 1.

FIG. 1 is a perspective view illustrating a microwave oven 10 including a hood 201, according to an embodiment of the invention. FIG. 2 is a perspective view illustrating the hood 201 of the microwave oven 10 of FIG. 1. FIG. 3 is a perspective view illustrating an installation bracket 120 of the hood 201 of the microwave oven of FIG. 1. FIG. 4 is a front view illustrating a front panel 240 of the hood 201 of the microwave oven 10 of FIG. 1. FIG. 5 is a block diagram of the hood 201 of the microwave oven 10 of FIG. 1.

Referring to FIG. 1, a cooking device 1 may be disposed in a kitchen. In the illustration of FIG. 1, the cooking device 1 is a gas range that is provided at an upper surface of an oven, a cabinet, or kitchen counter, so as to heat food using a gaseous fuel. It is noted that that the cooking device 1 is not limited to a gas-type device and may be any type of available cooking device. For example, the cooking device 1 may be an electric range that is provided at an upper surface of an oven or kitchen counter, so as to heat food using electricity.

The microwave oven 10 including the hood 201 may be disposed above the cooking device 1. The microwave oven 10 has a cooking function in which food may be heated using microwaves and/or heat, and an air exhaust function in which contaminated air generated while cooking food on the cooking device 1 may be exhausted to an outdoor space or purified to be circulated back to an indoor space. Because the cooking functions of the microwave oven 10, and various parts for performing the cooking function, are well known, a detailed description thereof will be omitted.

The microwave oven 10 is provided with a cavity (not shown) that provides a cooking chamber (not shown) where food may be cooked. The microwave oven 10 includes a door 11 for selectively opening and closing the cooking chamber. The microwave 10 may further include a control panel 13 that may receive operation signals for operating the microwave oven 10 and that may display information about the operation thereof. The microwave oven 10 may include a heat source (not shown) for cooking food in the cooking chamber, e.g., a high-frequency heat source and/or a radiation heat source and/or a convection heat source.

A passage for performing the air exhaust process may be disposed in the microwave oven 10. Particularly, the microwave oven 10 may include an outdoor exhaust passage (not shown) and an indoor exhaust passage (not shown) therein. The outdoor exhaust passage may guide contaminated air introduced through a main intake port 113 (FIG. 2), or through both the main intake port 113 and an auxiliary intake port 211 (FIG. 2), to an outdoor space. The indoor exhaust passage (not shown) may guide contaminated air introduced through a main intake port 113 (FIG. 2), or through both the main intake port 113 and an auxiliary intake port 211 (FIG. 2) through a filter device 15 (FIG. 2), e.g., a wire mesh screen, carbon material, or a combination of wire mesh and carbon material, to purify the air and may further guide the purified air to an exhaust port faced with a discharge grill 15 to exhaust the purified air back to an indoor space. The discharge grill 15 may be provided to a front upper vertical surface of the microwave oven 10, e.g., above the door 11. Because the outdoor exhaust passage, the indoor exhaust passage, and the filter 115 may be the same as those of a related art microwave oven including a hood, a description thereof will be omitted.

A vent fan 300 (FIG. 5) may be disposed in the microwave oven 10. The vent fan 300 may facilitate a flow of air into the main intake port 113 or both the main intake port 113 and the auxiliary intake port 211. The air may then flow in the outdoor exhaust passage or the indoor exhaust passage, may then be exhausted to an outdoor or indoor space, respectively.

The lower portion of the microwave oven 10 may be provided with a hood casing 101 for the hood 201. The hood casing 101 may aid the hood 201 in guiding contaminated air generated while cooking food on the cooking device 1 to the indoor and/or outdoor exhaust passages. The hood casing 101 may be fixed to a bottom surface of the microwave oven 10. The hood 201 may be slidably received within the hood casing 101 and the hood 201 may slide in a back-and-forth movement in a direction parallel to a bottom surface the microwave oven 10 (e.g., into and out of the hood casing 101).

Particularly, referring to FIG. 2, the hood casing 101 has a substantially slim hexahedron shape with an open upper surface. The hood casing 101 and the microwave oven 10 may have the same horizontal dimension; however this dimension is not a limiting factor of the invention. The hood casing 101 may be provided discretely at the lower portion of the microwave oven 10. Thus, the hood casing 101 may substantially provide both partial side surfaces and the bottom appearance of the microwave oven 10. The hood casing 101 and/or the hood 201 may be integral to the microwave oven 10, or may be separate from, and configured for placement under, the microwave oven 10.

The front surface of the hood casing 101 may be provided with a drawer opening 111. The drawer opening 111 permits the hood 201 to be extracted from and retracted into the hood casing 101. The drawer opening 111 may be formed by cutting a portion of the front surface of the hood casing 101. Other methods known in the art may also be utilized to form the drawer opening 111.

The bottom surface of the hood casing 101 may be provided with the main intake port 113 that functions as an inlet for drawing in contaminated air generated while cooking food on the cooking device 1. The main intake port 113 may be formed by cutting portions of a bottom surface of the hood casing 101. Other methods known in the art may also be utilized to form the main intake port 113.

When the hood casing 101 is provided at the lower portion of the microwave oven 10, the main intake port 113 may fluidly communicate with the outdoor exhaust passage and the indoor exhaust passage.

A filter 115 may be disposed on or in the main intake port 113 to remove contaminants from air drawn into the main intake port 113.

Illumination openings 116 may be provided to the bottom surface of the hood casing 101 on both sides of the main intake port 113, respectively. Lamp assemblies 410 may be disposed on the illumination openings 116 to illuminate the cooking device 1. Although not shown, cover glass may be disposed on the illumination openings 116. The cover glass may prevent the lamp assemblies 410 from being affected by contaminants contained in the air generated while cooking on cooking device 1.

Two installation brackets 120A and 120B may be provided to the bottom surface of the hood casing 101. Both installation brackets 120A and 120B are illustrated in FIG. 2. The installation brackets 120A and 120B may be symmetrical to each other, although symmetry of the brackets is not a limitation of the invention. For purposes of simplified explanation, only installation bracket 120A is illustrated in FIG. 3, however, as used herein reference number 120 may be used to refer to installation brackets 120A and 120B either collectively or individually. The installation brackets 120 may be used for installing a driving motor 130, a driving gear (not shown), and first through third driven gears 140, 150, and 160 (FIG. 6) that will be described later. The installation brackets 120 may be disposed on both sides of a bottom surface of the hood casing 101, each between a side surface of the hood casing 101 and the main intake port 113. Referring to FIG. 3, the installation bracket 120 includes a bracket main body 121, a motor installation member 123 (hereinafter installation rib 123), a partition member 125 (hereinafter partition rib 125), a shaft support member 127 (hereinafter shaft support rib 127), and first and second switch installation members 128 and 129, respectively (hereinafter first and second switch installation ribs 128 and 129, respectively).

In the illustrated embodiments, the motor installation rib 123 may extend upward from a side edge of the bracket main body 121 and may be substantially parallel to one side surface of the hood casing 101. The driving motor 130 (FIG. 2) may be provided at the motor installation rib 123. In the embodiment of FIG. 2, the motor installation rib 123 is provided only to the installation bracket 120 that is disposed on the right side of the hood casing 101 (i.e., 120A). In this illustrated embodiment, a single driving motor 130 may be provided for driving driven gears on opposing sides of the hood 201.

The partition rib 125 may extend upward from a side edge of the bracket main body 121 opposite to the side edge from which the motor installation rib 123 extends. The partition rib 125 may act to separate a space defining the contaminated air flow path from a space where the driving motor 130 is disposed. To effectuate this separation, the partition rib 125 may have a predetermined length to permit a distal end of the partition rib 125 to contact, or be configured to form a seal between the rear surface of the hood casing 101 and the distal end of the partition rib 125. Further, a top side of the partition rib 125 may be in contact with the bottom surface of the microwave oven 10 or be configured to form a seal between the bottom surface of the microwave oven 10 and the top side of the partition rib 125 when the hood casing 101 is disposed below the microwave oven 10.

In the present embodiment, the partition rib 125 and the installation bracket 120 are formed in one piece, but the present invention is not limited thereto. That is, the partition rib 125 may be formed apart from the installation bracket 120 and be provided on the bottom surface of the hood casing 101. When the partition rib 125 is formed apart from the installation brackets 120, the partition rib 125 may be longitudinally provided at the bottom surface of the hood casing 101 between the main intake port 113 and the installation bracket 120.

The partition rib 125 may be provided with a guide slot 125A and a shaft through-hole 125B. The guide slot 125A may be formed by cutting a portion of the partition rib 125 with predetermined length and height from the partition rib 125. The guide slot 125A may be formed in a lengthwise orientation along the partition rib 125. Other methods known in the art may also be utilized to form the guide slot 125A. The guide slot 125A may be used to prevent interference with the hood 201 as it extends from and retracts into the drawer opening 111. To this end, a portion of the hood 201 may be retracted into the guide slot 125A. A transmission shaft 170 (FIG. 2) may pass through the shaft through hole 125B. A portion of the partition rib 125 may be cut to space the shaft through hole 125B a predetermined distance from the rear end of the guide slot 125A.

The shaft support rib 127 may extend upward from an edge of the installation bracket 120 opposite that of the partition rib 125, e.g., from the edge of the bracket main body 121 provided with the motor installation rib 123. Nothing herein should be construed as limiting the projections of any rib to only the edges of the installation bracket. The shaft support rib 127 may be parallel to and may overlap both edges of shaft through hole 125B in the lengthwise direction of the installation bracket 120. The end of the transmission shaft 170 may be rotatably supported by the shaft support rib 127. One or both ends of the transmission shaft 170 may be supported by use of respectively proximate shaft support ribs 127.

The first and second switch installation ribs 128 and 129, respectively, may be provided with first and second switches 180 (FIGS. 2 & 6) and 190 (FIGS. 2 & 6), respectively. The first switch installation rib 128 may extend horizontally from the upper end of the partition rib 125 adjacent to and toward the shaft support rib 127. The second switch installation rib 129 may extend horizontally in the rear upper end of the partition rib 125 in the same direction as the first switch installation rib 128.

Referring again to FIG. 2, the installation bracket 120, and more particularly, the motor installation rib 123 may be provided with a driving motor 130. The driving motor 130 provides a driving force used to extend and retract the hood 201. The driving motor 130 may be any motor capable of providing a driving force in both directions. In the illustrated embodiment of FIG. 2, the driving motor 130 is provided only on the installation bracket 120A on the right side of hood casing 101, however, two driving motors may be provided, one to each of the two installation brackets 120A and 120B. Therefore, nothing in this disclosure is meant to limit the number or placement of driving motor(s). When the driving motor 130 is provided on only one of the installation brackets 120, the motor installation rib 123 may be removed from the installation bracket 120 not fitted with the motor 130.

Hereinafter, for convenience in description, a driving direction of the driving motor 130 in which at least a portion of the hood 201 is extended from the inside of the hood casing 101 toward the outside of the hood casing 101, is referred to as a forward direction, and an opposite direction to the forward direction is called a reverse direction.

Figure 6:
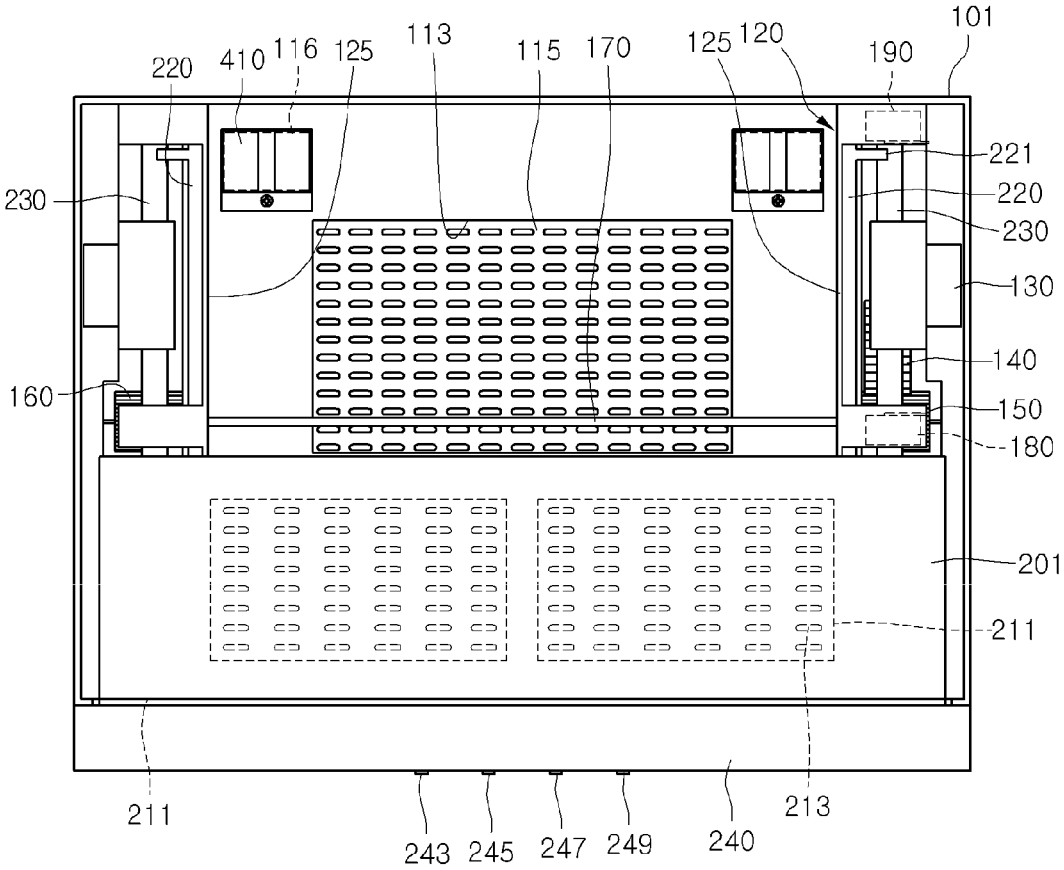
FIG. 6 is a bottom view illustrating the hood of the microwave oven of FIG. 1, where the hood is in a retracted position, all according to an embodiment of the invention.
Figure 7:
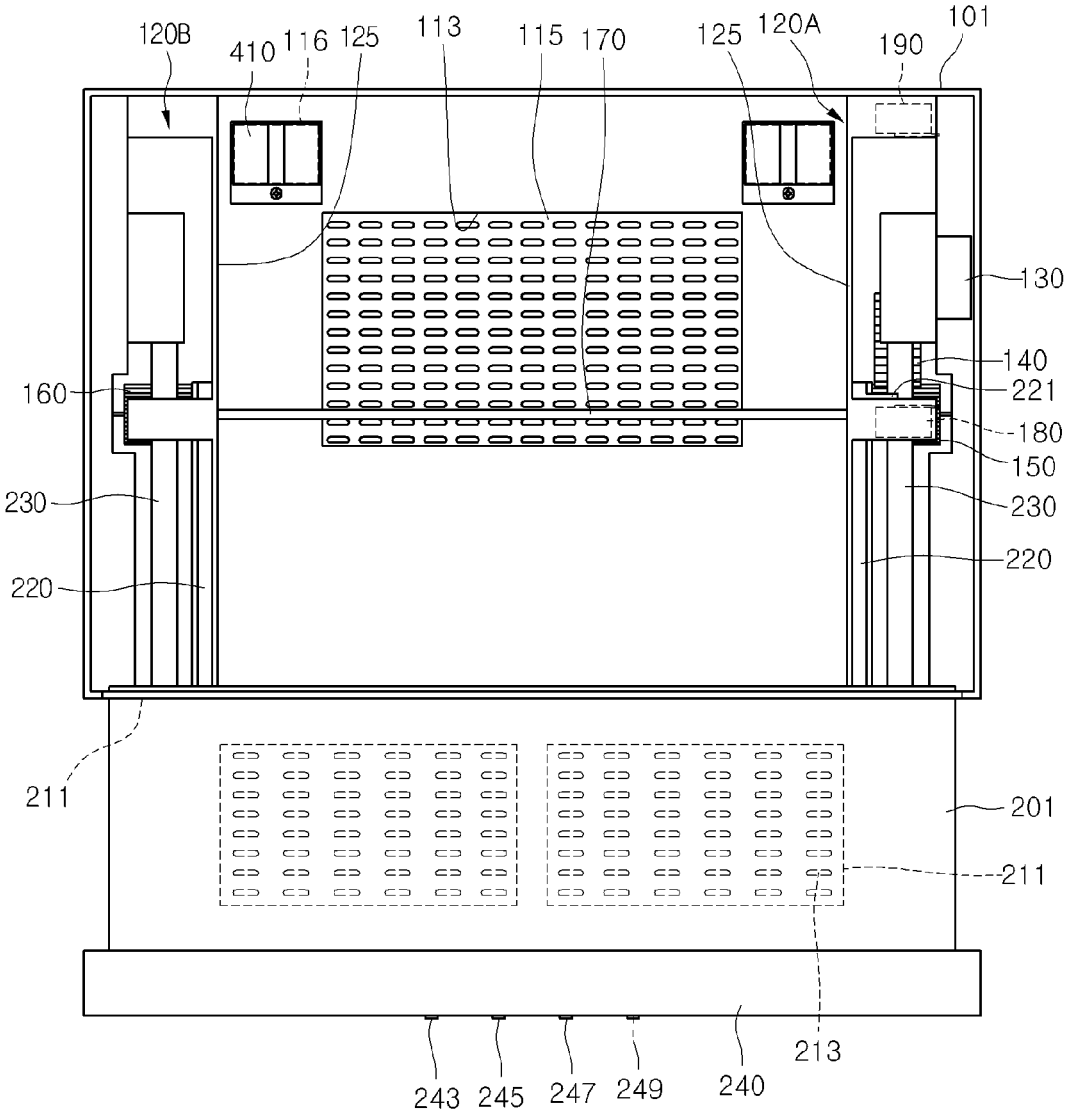
FIG. 7 is a bottom view illustrating the hood of the microwave oven of FIG. 1, where the hood is in an extended position, all according to an embodiment of the invention.

In an embodiment, a driving force of the driving motor 130 is transmitted to the hood 201 by at least one driving gear (not shown) and the first through third driven gears 140, 150, and 160 (FIGS. 6 & 7). To this end, the driving gear may be coupled to a driving shaft (not shown) of the driving motor 130. The first driven gear 140 may be rotatably supported at the motor installation rib 123 and engages with the driving gear. The second and third driven gears 150 and 160 (FIGS. 6 & 7) are provided to the ends of the transmission shaft 170 that pass through the shaft through hole 125B in an outward direction. The second driven gear 150 engages the first driven gear 140. Thus, the second driven gear 150 is provided to one end of the transmission shaft 170, where the transmission shaft 170 is rotatably supported by the shaft support rib 127 of the installation bracket 120. In the embodiment of FIG. 2, the second driven gear 150 is disposed on the right side of the hood casing 101, the side of the hood casing 101 to which the driving motor 130 is disposed. The third driven gear 160 (FIGS. 6 & 7) may be provided to an end of the transmission shaft 170 opposite the end coupled to drive gear 150.

The number of driving gears and the number of first driven gears may be equal to the number of driving motors. That is, when the single driving motor 130 is provided according to the present embodiment, the single driving gear and the single first driven gear 140 are provided. Alternatively, when a pair of driving motors 130 is provided to the pair of installation brackets 120, each of the driving gear and the first driven gear 140 is provided to each of the pair. When the single driving motor 130 is provided to a first side, the single second driven gear 150 and the single third driven gear 160 are provided. Alternatively, when a second driving motor is provided to the opposite, second, side, the second driven gear is also provided in duplicate, and the third driven gear 160 is removed (or effectively becomes the second driven gear to the paired combination of motor and gears on the second side). The shaft connecting the first and third driven gears could also be removed in an embodiment having paired driving motors. Of course, in such an embodiment, each of the two second driven gears would require its own axle, which could be configured to mount to the installation brackets 120.

As illustrated in FIG. 2, the first and second switch installation ribs 128 and 129 may be provided with the first and second switches 180 and 190, respectively. The first switch 180 may generate a signal to stop the driving motor 130 when the hood 201 is extended from the hood casing 101 to a position of maximum extension from the hood casing 101. The second switch 190 may generate a signal to stop the driving motor 130 when the hood 201 is refracted into the hood casing 101 to a position where it is fully retracted into the hood casing 101.

The hood 201 may have a slim hexahedron shape with an open rear surface and with a vertical section approximately corresponding to the drawer opening 111. The hood 201 may slide back-and-forth so that the hood 201 may be extended from or refracted into the hood casing 101 through the drawer opening 111. A surface of the hood 201 may be retracted into and move along the guide slots 125A as it slides into hood casing 101.

The bottom surface of the hood 201 may be provided with the auxiliary intake port 211. The auxiliary intake port 211 may function when the hood 201 is extended from the hood casing 101 as an inlet for drawing in contaminated air generated while cooking food on the cooking device 1. The auxiliary intake port 211 may be formed by cutting portions of a bottom surface of the hood 201. Other methods known in the art for forming the auxiliary intake port 211 may also be used. The auxiliary intake port 211 may be disposed toward a front of, and below, the main intake port 113 when the hood 201 is in a retracted position within the hood casing 101.

In the embodiments described herein, the upper and lower surfaces of the hood 201 do not overlap the main intake port 113 in the vertical direction when the hood 201 is retracted into the hood casing 101. This configuration may prevent contaminated air, drawn through the main intake port 113, from being blocked (partially or completely) with the hood 201 when the hood 201 is in a retracted position within the hood casing 101.

In an alternate embodiment where the rear end of the hood 201 is disposed below and behind the main intake port 113 when the hood 201 is in a retracted position within the hood casing 101, the auxiliary intake port 211 may overlap at least a portion of the main intake port 113 in the vertical direction. However, the same effect as described above can be obtained. In other words, contaminated air drawn through the main intake port 113 will then first flow through the auxiliary intake port 211 before entering the main intake port 113, thus preventing air drawn in through the main intake port 113 from being blocked by the hood 201.

One or more auxiliary filters 213 may be disposed on the auxiliary intake port 211 to remove contaminants from air drawn in through the auxiliary intake port 211. The functioning of the auxiliary filter is similar to the main filter 115.

As illustrated in FIGS. 6 and 7, the hood 201 may be provided with two partition bars 220, which can prevent contaminated air, drawn into the auxiliary intake port 211 when the hood 201 is extended from the hood casing 101, from flowing into the space where, for example, the driving motor 130 is disposed. The partition bar 220 may have a bar shape with a longitudinal section that corresponds to the longitudinal section of the inner space of the hood 201 and with a predetermined length in the direction of movement (extension and retraction) of the hood 201. The length of the partition bar 220 may be determined such that the partition bar 220 overlaps at least a portion of the partition rib 125 when the hood 201 is extended from the hood casing 101 such that there is no interference with the retraction of the hood 201 into the hood casing 101. For example, the length of the partition bar 220 may be determined to be a length defined by the length of the hood 201 and the length of the hood casing 101. The partition bar 220 may be disposed in the inner space defined by the installation bracket 120, that is, between the partition rib 125 and both the motor installation rib 123 and the shaft support rib 127. Other mechanisms adapted to overlap at least a portion of the partition rib 125 when the hood 201 is extended from the hood casing 101 such that there is no interference with the retraction of the hood 201 into the hood casing 101 are within the scope of the invention.

The distal end of the partition bar 220 may be provided with a driving protrusion 221 that contacts the first and second switches 180 and 190 according to the extension and retraction of the hood 201. More particularly, the driving protrusion 221 may cause the first switch 180 to close (or open) when the hood 201 is extended completely from the hood casing 101. Furthermore, the driving protrusion 221 may cause the second switch 190 to close (or open) when the hood 201 is retracted completely within the hood casing 101. The closing (or opening) of each switch 180 and 190 may serve to power-off the driving motor 130 upon completion of the extension or retraction of the hood 201.

The partition bars 220 may be provided with racks 230, respectively. The racks 230 may be connected to the second and third driven gears 150 and 160, respectively. Thus, when the driving motor 130 is driven, a driving force of the driving motor 130 may be transmitted to the hood 201 through the driving gear, the first through third driven gears 140, 150, and 160, and the racks 230.

The front surface of the hood 201 may be provided with the front panel 240 that substantially defines the front surface of the hood 201. The front panel 240 may have a shape that substantially corresponds to the front surface of the hood casing 101. Thus, as illustrated in the disclosed embodiments, a rear surface of the front panel 240 may be in contact with the front surface of the hood casing 101 when the hood 201 is refracted into the hood casing 101. Of course, in other embodiments, a front surface of the front panel 240 may be flush with the front surface of the hood casing 101 when the hood 201 is retracted into the hood casing 101. The relative positions of the front or rear surfaces of the front panel 240 with respect to the front surface of the hood casing when the hood 201 is refracted into the hood casing 101 is not a limitation of the invention. The lower end of the front panel 240 may be provided with a rounded or angled part 241 that is formed by partially bending the lower end of the front panel 240 at a predetermined curvature or angle. The angled part 241 protects a user from colliding with a corner of the front panel 240 when the hood 201 is extended from the hood casing 101, and provides a line of sight to allow the user to readily view an operation of the cooking device 1.

Referring to FIGS. 4 and 5, the front panel 240 may be provided with operation controls, such as buttons, that include a hood extend button 243, a hood retract button 245, a vent fan on/off button 247, and an illumination button 249.

The hood extend button 243 operates to start the extension of the hood 201 from the hood casing 101, and an operational signal to stop the extension of the hood 201 from the hood casing 101. More particularly, in the state where the hood 201 is in a retracted position within the hood casing 101 and the driving motor 130 is stopped, when the hood extend button 243 is selected, the driving motor 130 may be rotated in a forward direction to cause the hood 201 to extend from the hood casing 101. The hood 201 may be stopped at either a predetermined distance from the hood casing 101 or at any distance from the hood casing 101 that is less than or equal to a fully extended position (by, for example, in one embodiment releasing the hood extend button 243 or, in another embodiment again selecting the hood extend button 243).

The hood retract button 245 operates to start the retraction of the hood 201 into the hood casing 101, and an operational signal to stop the retraction of the hood 201 into the hood casing 101. More particularly, in the state where the hood 201 is in an extended position from the hood casing 101 and the driving motor 130 is stopped, when the hood retract button 243 is selected, the driving motor 130 may be rotated in a reverse direction to cause the hood 201 to retract into the hood casing 101. The hood 201 may be stopped at either a predetermined distance from the hood casing 101 or at any distance from the hood casing 101, which is equal to or less than a fully retracted position.

The vent fan on/off button 247 operates to turn on or off the vent fan 300. Thus, when the vent fan on/off button 247 is selected in the state where the vent fan 300 is off, the vent fan 300 is turned on. When the vent fan on/off button 247 is manipulated in the state where the vent fan 300 is on, the vent fan 300 is turned off.

The illumination button 249 operates to turn the lamp assemblies 410 on or off. In other words, if the illumination button 249 is selected when the lamp assemblies 410 are off, the lamp assemblies 410 are turned on. When the illumination button 249 is selected when the lamp assemblies 410 are on, the lamp assemblies 410 are turned off.

In the present embodiment, the hood extend button 243, the hood retract button 245, the vent fan on/off button 247, and the illumination button 249 are provided at the front panel 240, but the invention is not limited thereto. For example, the front panel 240 may be provided only with the hood extend 243 and hood retract 245 buttons. Alternatively, a single button may be provided to control both operations. By way of further example, any combination of controls, such as buttons 243, 245, 247, and 249 may be provided.

Hereinafter, an operation of the microwave oven 10 including an extendable/retractable hood 201 in accordance with an embodiment of the invention will be described in detail with reference to the accompanying drawings.

FIG. 6 is a bottom view illustrating the hood 201 of the microwave oven 10 of FIG. 1, where the hood 201 is in a retracted position, and FIG. 7 is a bottom view illustrating the hood 201 of the microwave oven 10 of FIG. 1, where the hood 201 is in an extended position, all according to an embodiment of the invention.

Referring to FIG. 6, when the hood extend button 243 is selected, the driving motor 130 may rotate in a direction to cause the hood 201 to extend from the hood casing 101. Thus, the driving gear, and the first through third driven gears 140, 150, and 160 that are coupled to the driving motor 130 are rotated, and the racks 230 engaging with the second and third driven gears 150 and 160 move to extend the hood 201 from the front side of the microwave oven 10.

When the driving motor 130 is rotated and the hood 201 is extended completely from the hood casing 101, the driving protrusion 221 closes (or opens) the first switch 180. The closing (or opening) of the first switch 180 causes the generation of a signal to stop the rotation of the driving motor 130, and the driving motor 130 is thus stopped.

In this state, when the vent fan on/off button 247 is operated, the vent fan 300 is driven to draw air, which may contain contamination generated while cooking food on the cooking device 1, into the microwave oven 10 through one or both of the main intake port 113 and the auxiliary intake port 211. The air drawn in may pass through one or both of the main filter 113 and auxiliary filter 213 to remove contaminants at the filter. The air flowing into the microwave oven 10 may be moved along the outdoor exhaust passage and exhausted to an outdoor space, or the air may be moved along the indoor exhaust passage and exhausted to an indoor space through the exhaust grill 15.

Referring to FIG. 7, when the cooking of the food on the cooking device 1 is completed, and the exhausting of contaminated air generated during the cooking on the cooking device 1 is finished, the vent fan on/off button 247 may be selected to turn off, and thus stop, the driving of the vent fan 300.

In this state, when the hood retract button 245 is selected, the driving motor 130 may be rotated in a direction to cause the hood 201 to retract into the hood casing 101. Thus, the driving gear, and the first through third driven gears 140, 150, and 160 that are coupled to the driving motor 130 are rotated, and the racks 230 engaging with the second and third driven gears 150 and 160 move to retract the hood 201 into the microwave oven 10.

When the driving motor 130 is rotated and the hood 201 is retracted completely into the hood casing 101, the driving protrusion 221 closes (or opens) the second switch 190. The closing (or opening) of the second switch 190 causes the generation of a signal to stop the rotation of the driving motor 130, and the driving motor 130 is thus stopped.

In an embodiment, even before the hood 201 is extended completely from the hood casing 101, or even before the hood 201 is retracted completely into the hood casing 101, the hood extend button 243 or the hood retract button 245 can be selected. When the hood extend button 243 or the hood retract button 245 is selected while the hood 201 is moving, the rotation of the driving motor 130 is stopped. In this state, the vent fan on/off button 247 may be selected to drive the vent fan 300, thus performing the air exhaust function.

Hereinafter, an operation of the microwave oven 10 including an extendable/retractable hood 202 in accordance with an embodiment of the invention will be described in detail with reference to the accompanying drawings.

Figure 8:
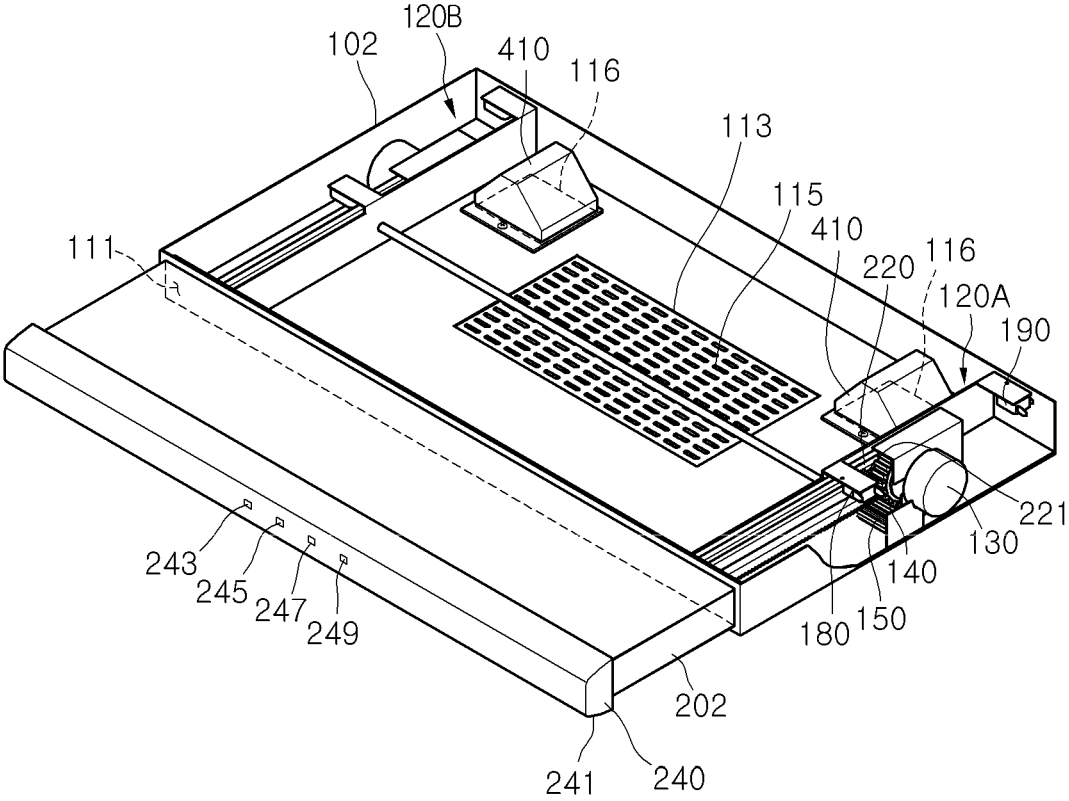
FIG. 8 is a perspective view illustrating the hood of a microwave oven, according to another embodiment of the invention.

FIG. 8 is a perspective view illustrating the hood 202 of a microwave oven 10 according to another embodiment of the invention. In the embodiments of FIGS. 1 to 8, like reference numerals denote like elements, and thus a description thereof will be omitted.

Referring to FIG. 8, a hood casing 102 and the hood 202 are provided, which replace the hood casing 101 and the hood 201 of the previous embodiment, respectively. The hood casing 102 has the substantially same configuration as the hood casing 101. The hood 202 also has substantially the same configuration as the hood 201, except, in this embodiment, the auxiliary intake port 211 is not present. The underside surface of the hood 202 may be closed or open. In the illustrated embodiment, the underside is open, thus allowing contaminated air to flow into the extended portion of the hood 202, but without passing the air flowing into the extended portion of the hood through filters. Furthermore, the hood 202 is substantially similar to the hood 201 in that the hood 202 slides back-and-forth so that the hood 202 is retracted into and extended from the hood casing 102. As illustrated, the mechanism for extending and retracting the hood 202 are the same as in the previous embodiment.

Hereinafter, an operation of the microwave oven 10 including an extendable/retractable hood 203 in accordance with an embodiment of the invention will be described in detail with reference to the accompanying drawings.

Figure 9:
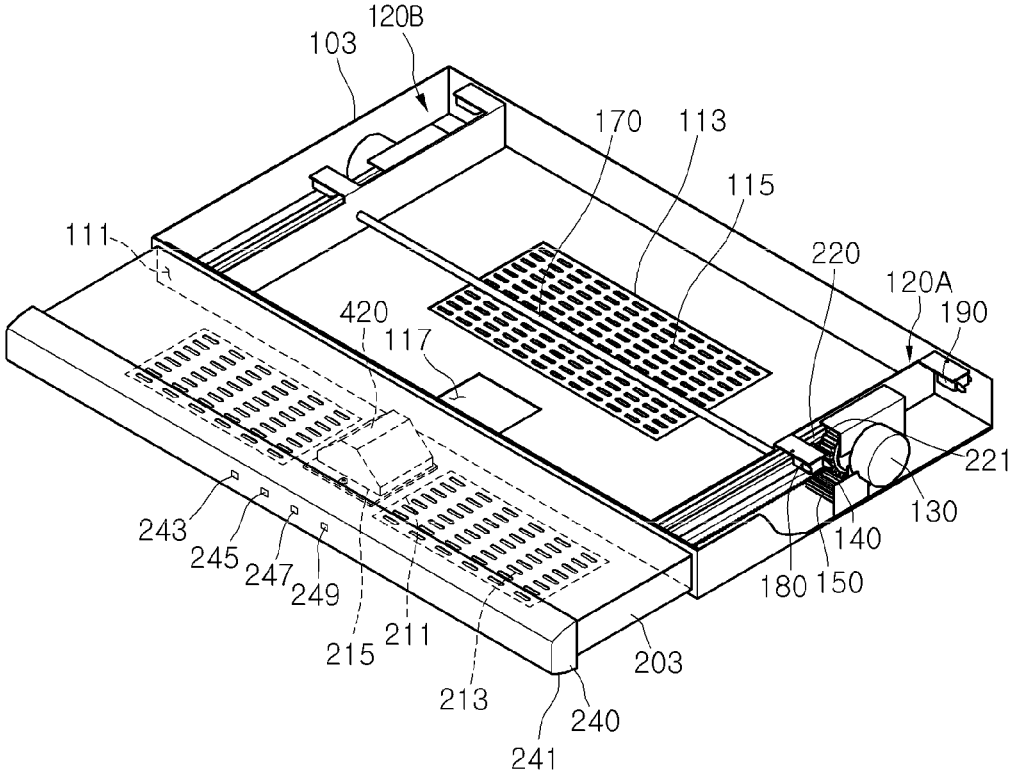
FIG. 9 is a perspective view illustrating the hood of a microwave oven, according to still another embodiment of the invention.

FIG. 9 is a perspective view illustrating the hood of a microwave oven, according to still another embodiment of the invention. In the embodiments of FIGS. 1 to 9, like reference numerals denote like elements, and thus a description thereof will be omitted.

Referring to FIG. 9, a hood casing 103 and the hood 203 are provided, which replace the hood casings 101, 102 and the hoods 201, 203 of the previous embodiments, respectively. The hood casing 103 has the substantially same configuration as the hood casing 101 except illumination openings 116 and lamp assemblies 410 are not provided to the bottom distal surface of the hood casing 103. Additionally, the bottom proximal surface of the hood casing 103 is provided with an opening 117 that is formed by removing a portion of the bottom surface of the hood casing 103. The hood 203 has substantially the same configuration as the hood 201 (FIGS. 2, 6, and 7), except, in this embodiment, a lamp assembly 420 is coupled to the bottom surface of the hood 203. The bottom surface of the hood 203 may be provided with an illumination opening 215 that vertically overlaps the opening 117 when the hood 203 is retracted into the hood casing 103. The lamp assembly 420 may be disposed at the illumination opening 215 to illuminate the cooking device 1.

Light from the lamp assembly 420 may pass downward through the illumination opening 215 and the opening 117 to illuminate the cooking device 1 (FIG. 1) when the hood is in its retracted position. Light from the lamp assembly 420 may pass downward through the illumination opening 215 to illuminate the cooking device 1 (FIG. 1) when the hood is in its extended position.

Although not shown, a cover glass may be disposed on the illumination opening 215. The cover glass may prevent the lamp assembly 420 from being affected by contaminants contained in the air generated while cooking on cooking device 1.

In the hood casing 103 and the hood 203, a mechanism for drawing in contaminated air and a mechanism for extending and retracting the hood 203 may be the same as those of the embodiment of FIGS. 1 to 7.

Figure 10:
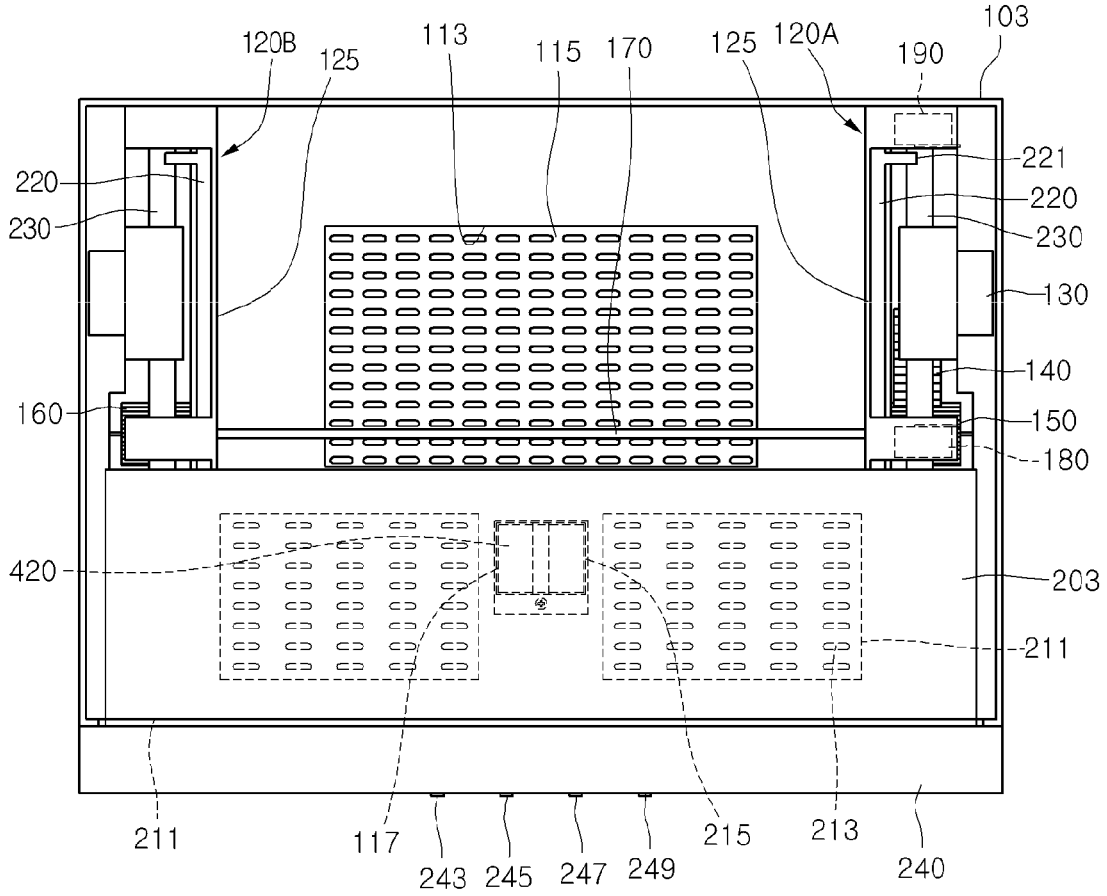
FIG. 10 is a bottom view illustrating the hood of the microwave oven of FIG. 9, where the hood is in a retracted position, all according to an embodiment of the invention.
Figure 11:
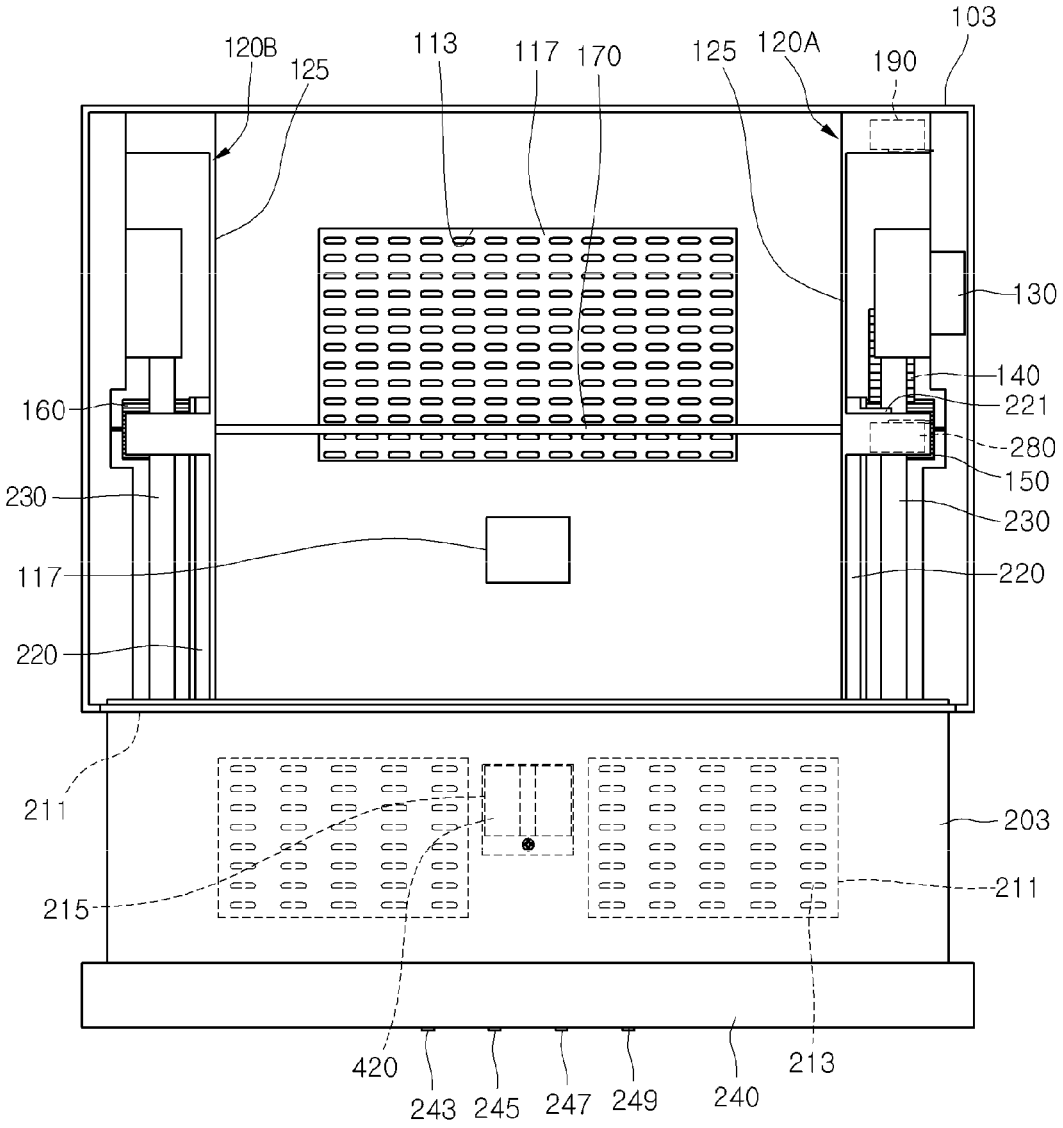
FIG. 11 is a bottom view illustrating the hood of the microwave oven of FIG. 9, where the hood is in an extended position, all according to an embodiment of the invention.

FIG. 10 is a bottom view illustrating the hood 203 of the microwave oven 10 of FIG. 9, where the hood 203 is in a retracted position, and FIG. 11 is a bottom view illustrating the hood 203 of the microwave oven 10 of FIG. 9, where the hood 203 is in an extended position, all according to an embodiment of the invention.

Referring to FIG. 10, when the hood 203 is retracted into the hood casing 103, the lamp assembly 420, the illumination opening 215 and the opening 117 may be vertically aligned with each other. In this state, when the light control, such as the lighting button 249 (FIGS. 4 & 5) is selected, the lamp assembly 420 is turned on or off. When turned on, light from the lamp assembly 420 travels downward through the illumination opening 215 and the opening 117. Thus, the cooking device 1 may be illuminated by the lamp assembly 420.

Referring to FIG. 11, when the hood 203 is extended from the hood casing 103, the lamp assembly 420 and the illumination opening 215 are also extended from the hood casing 103. In this state, when the lighting button 249 is selected the lamp assembly 420 is turned on or off. When turned on, light from the lamp assembly 420 travels downward through the illumination opening 215. Thus, the cooking device 1 may be illuminated by the lamp assembly 420.

Hereinafter, an operation of the microwave oven 10 including an extendable/retractable hood 204 in accordance with yet another embodiment of the invention will be described in detail with reference to the accompanying drawings.

Figure 12:
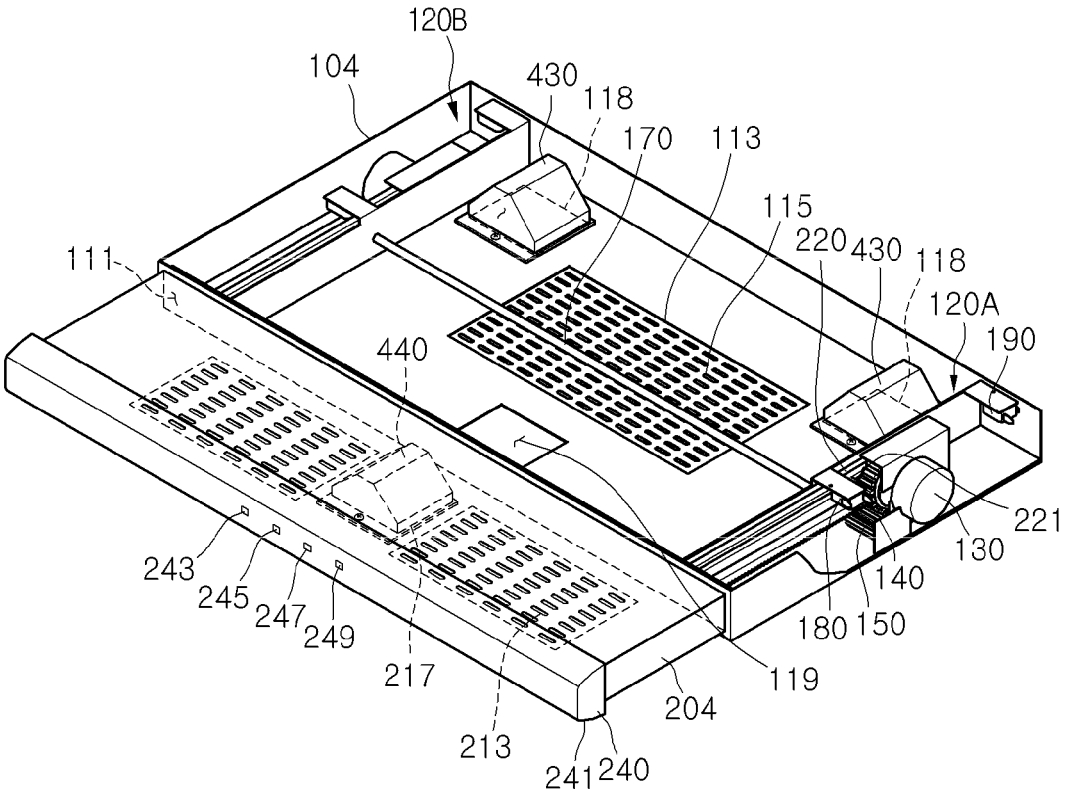
FIG. 12 is a perspective view illustrating a hood of a microwave oven, according to yet another embodiment of the invention.

FIG. 12 is a perspective view illustrating a hood of a microwave oven, according to yet another embodiment of the invention. In the embodiments of FIGS. 1 to 12, like reference numerals denote like elements, and thus a description thereof will be omitted.

Referring to FIG. 12, a hood casing 104 and the hood 204 are provided, which replace the hood casings 101, 102, 103 and the hoods 201, 202, 203 of the previous embodiments, respectively. The hood casing 104 has the substantially same configurations as the hood casings 101 and 102. Illumination openings 118 may be provided to the bottom distal surface of the hood casing 104 on both sides of the main intake port 113, respectively. Lamp assemblies 430 may be disposed on the illumination openings 118 to illuminate the cooking device 1. Additionally, the bottom proximal surface of the hood casing 104 is provided with an opening 119 that is formed by removing a portion of the bottom surface of the hood casing 104.

The hood 204 has substantially the same configuration as the hood 203. In the embodiment of FIG. 12, a lamp assembly 440 is coupled to the bottom surface of the hood 204. The bottom surface of the hood 204 may be provided with an illumination opening 217 that vertically overlaps the opening 119 when the hood 204 is retracted into the hood casing 104. The lamp assembly 440 may be disposed at the illumination opening 217 to illuminate the cooking device 1. Although not shown, cover glass may be disposed on the illumination openings 118, 217. The cover glass may prevent the lamp assemblies 430, 440 from being affected by contaminants contained in the air generated while cooking on cooking device 1.

In the hood casing 104 and the hood 204, a mechanism for drawing in contaminated air and a mechanism for extending and retracting the hood 204 may be the same as those of the embodiment of FIGS. 1 to 7.

Similar to the other embodiments, the lamp assemblies 430, 440 may be turned on by selecting the light button 249 (FIGS. 4 & 5), regardless of whether the hood 204 is retracted into or extended from the hood casing 104. Thus, when the hood 204 is retracted into the hood casing 104, light from the lamp assemblies 430, 440 travels downward through the illumination openings 118, 119 to illuminate the cooking device 1 (FIG. 1). When the hood 204 is extended from the hood casing 104, light from lamp assemblies 430 travels downward through the illumination openings 118 to illuminate cooking device 1. Light from the lamp assembly 440 may pass downward through the illumination opening 217 and the opening 119 to illuminate the cooking device 1 (FIG. 1) when the hood is in its retracted position.

In an alternative embodiment, lamp assemblies 430 may be turned on by selecting the light button 249, regardless of the whether the hood 204 is retracted into or extended from the hood casing 104. However, in the alternative embodiment, lamp assembly 440 may be turned on by selecting the light button 249 only when the hood 204 is extended from the hood casing 104. Thus, when the hood 204 is retracted into the hood casing 104, light from lamp assemblies 430 travels downward through the main illumination openings 118 to illuminate the cooking device 1. When the hood 204 is extended from the hood casing 104, light from lamp assemblies 430 travels through the main illumination openings 118, and light of lamp assembly 440 travels downward through illumination opening 217. In this alternative embodiment, the opening 119 may be omitted. In any embodiment, it will be understood that locations and quantities of lamp assemblies are within the scope of the invention.

The microwave oven including extendable/retractable hood according to the embodiments has the following effects.

As the hood is retracted into and extended from the microwave oven, the area for drawing in air may be substantially increased. Thus, a user can freely cook food without worry of contaminating the indoor environment with the odor of cooking.

In addition, when the hood is retracted into the hood casing, the intake port of the hood casing does not substantially overlap the intake port of the hood in the direction in which contaminated air is drawn in. Thus, depending on the amount of contaminated air, the air exhaust function may be performed in the state where the hood is retracted into the hood casing or in the state where the hood is extended from the hood casing.

In addition, various elements for retracting and extending the hood may be disposed in the hood casing. Thus, because only the hood is refracted into or extended from the hood casing, while the other elements are fixed, the microwave oven may be protected from damage as the hood is moved.

In addition, the inner spaces of the hood casing and the hood are divided into a region(s) where contaminated air flows and a region(s) in which the components for retracting and extending the hood are disposed. This prevents contaminated air from contaminating or damaging the components.

In addition, a driving force for retracting and extending the hood is transmitted to both the side ends of the hood. Thus, the hood is retracted into and extended from the casing at a uniform speed, as a whole, thus improving reliability in the retracting and extending of the hood.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microwave oven configured to be positioned above a cooking device, comprising:

a hood casing including a first intake port into which air is drawn;

a hood slidably received in the hood casing, the hood including a second intake port into which air is drawn;

a driving motor to generate a drive force to slidably extend the hood from or retract the hood into the hood casing;

a transmission member to transmit the drive force from driving motor to the hood, the transmission member comprising at least one rack to the hood and at least one driving gear that transmits the drive force of the driving motor to the rack; and a partition member providing a seal that divides an inner space of the hood casing and the hood into a first region where air, drawn through at least one of the first and second intake ports, flows and a second region where the driving motor and the transmission member are disposed, the partition member comprising:

a partition rib connected to the hood casing; and a partition bar connected to the hood, at least a portion of the partition bar cooperating with the partition rib configured to maintain the seal.

2. The microwave oven according to claim 1, wherein the hood has a rear end that is offset horizontally from the first intake port when the hood is fully retracted into the hood casing.

3. The microwave oven according to claim 1, wherein the second intake port is vertically aligned with the first intake port when the hood is fully retracted into the hood casing, wherein at least a portion of each respective intake port overlaps a portion of the other respective intake port.

4. The microwave oven according to claim 1, wherein the hood comprises a control panel comprising:

a first button configured to control a retraction or extension of the hood from the hood casing;

a second button configured to control a flow of air drawn in through at least one of the first and second intake ports; and a third button configured to control a lamp that generates light for illuminating the cooking device.

5. The microwave oven according to claim 1, wherein the seal is configured to be maintained between the inner space of the hood casing and the hood as the hood is moved to extend from and retract into the hood casing.

6. The microwave oven according to claim 1, further comprising:

a bracket on which to install the driving motor, wherein the partition rib and the bracket are formed in one piece.

7. The microwave oven according to claim 1, wherein the transmission member further comprises a first switch and a second switch whose operation generates signals to stop the driving motor when the hood is extended completely from the hood casing and retracted completely into the hood casing, respectively.

8. The microwave oven according to claim 1, wherein the transmission member comprises:

a motor shaft coupled to the driving motor;

the at least one driving gear being coupled to the motor shaft;

a transmission shaft traversing a width from side-to-side of the hood casing;

a plurality of driven gears comprising:

a first driven gear engaging the driving gear;

a second driven gear engaging the first driven gear and coupled to a first end of the transmission shaft; and a third driven gear coupled to a second end of the transmission shaft; and the at least one rack being at least two racks coupled to the hood, the racks each engaging one of the second and third driven gears.

9. The microwave oven according to claim 8, wherein the driving motor is installed at one of two brackets that are fixedly coupled to the hood casing.

10. The microwave oven according to claim 8, wherein the transmission shaft passes through and is supported by the two brackets.

11. The microwave oven according to claim 1, further comprising:

an opening through a bottom surface of the hood casing;

a first illumination device mounted to the hood and corresponding to the size and shape of the opening, wherein when the hood is retracted into the hood casing the first illumination device vertically aligns with the opening to pass light generated at the first illumination device through the hood casing to illuminate the cooking device.

12. The microwave oven according to claim 11, further comprising:

a second illumination device coupled to the hood casing and configured to illuminate the cooking device.

* * * * *